US005532936A

United States Patent [19]

Perry

[11] Patent Number: 5,532,936

[45] Date of Patent: Jul. 2, 1996

[54] TRANSFORM METHOD AND SPECTROGRAPH FOR DISPLAYING CHARACTERISTICS OF SPEECH

[76] Inventor: John W. Perry, 7419 Cimmaron Sta. Dr., Columbus, Ohio 43235

[21] Appl. No.: 964,341

[22] Filed: Oct. 21, 1992

[51] Int. Cl.[6] ..... G10L 7/10

[52] U.S. Cl. ..... 364/514 A; 364/485; 381/45; 395/2.44; 434/185

[58] Field of Search ..... 381/48; 364/485, 364/487, 498, 514 A, 483; 384/41, 43, 45, 50; 84/477 R; 395/2.15, 2.16, 2.18, 2.44, 2.52, 2.85, 2.4, 2.8, 356 D; 434/185

[56] References Cited

U.S. PATENT DOCUMENTS

| | | | |
|---|---|---|---|
| 3,639,691 | 2/1972 | Beninghof, Jr. | 395/2.85 |
| 4,093,989 | 6/1978 | Flink et al. | 364/485 |
| 4,223,185 | 9/1980 | Picou | 364/726 |
| 4,276,445 | 6/1981 | Harbeson | 179/1 SC |
| 4,321,680 | 3/1982 | Bertrand et al. | 364/485 |
| 4,492,917 | 1/1985 | Inami et al. | 324/77 |
| 4,641,343 | 2/1987 | Holland et al. | 381/48 |
| 4,665,494 | 5/1987 | Tanaka et al. | 364/485 |
| 4,802,098 | 1/1989 | Hansen et al. | 364/487 |
| 4,833,716 | 5/1989 | Cote, Jr. | 381/48 |
| 4,852,176 | 7/1989 | Truhe, Jr. | 381/103 |
| 5,287,789 | 2/1994 | Zimmerman | 84/454 |
| 5,305,233 | 4/1994 | Kawagoe et al. | 364/526 |

*Primary Examiner*—Ellis B. Ramirez
*Assistant Examiner*—Craig Steven Miller
*Attorney, Agent, or Firm*—Standley & Gilcrest

[57] ABSTRACT

A method of transforming time-domain data to frequency-domain data by means of digital numerical models of damped oscillators, and a spectrograph implemented using said method.

3 Claims, 6 Drawing Sheets

TRANSFORM METHOD AND SPECTROGRAPH FOR DISPLAYING CHARACTERISTICS OF SPEECH

BACKGROUND

1. Field of Invention

This invention relates to methods of transforming data from the time domain to the frequency domain and to spectrographic devices, which convert time-domain information, such as audio signals, into a frequency-domain representation of this information.

2. Description of Prior Art

Methods of transforming time domain data to the frequency-domain using the methods of Fourier have been used for many years. Prior to the development of the Fast Fourier Transform technique (FFT) in the 1960s, Fourier transformation was extremely expensive computationally and was thus rarely used. The development of the FFT has made Fourier analysis much more efficient and practical and it has since found more widespread use. However, the FFT is still a computationally expensive technique, which has limited the performance of devices, such as digital spectrographs, which utilize it.

Spectrographs have been available for many years. Originally implemented as strictly analog devices, early spectrographs recorded spectrograms on a spinning drum, using an electric arc and special paper. These devices were severely limited in their ability to process and analyze input signals. They also were of limited resolution and their output was not useable in realtime since the drum had to be stopped and the paper unloaded. These devices also had a limited operating time, since the paper was quickly filled with spectrographic output.

Another frequency-domain device, the spectrum analyzer, is essentially a receiver which is swept through a range of frequencies, displaying the amplitude of received signals on a cathode ray tube. The use of one receiver to sequentially detect many different frequencies results in each frequency being detected only intermittently, with relatively long periods during which no detection occurs for each given frequency. Such an instrument is of limited usefulness in analyzing dynamic signals, i.e. signals in which the frequency spectra is changing and in which signals may be present at specific frequencies for a short time only.

To address these limitations, in recent years realtime spectrographs have been implemented on digital computers. The conversion of time domain to frequency domain is typically done in digital systems by using the mathematical method known as the Fast Fourier Transform (FFT). The Transform is computationally expensive and thus the conversion is typically performed by either a powerful mainframe computer or by a dedicated auxiliary processing unit known as a Digital Signal Processor (DSP). The hardware required by these systems is expensive and thus the systems themselves are generally found in a relatively small number of research laboratories. Many potential applications of realtime spectrographs are not currently realized due to the high cost of the hardware required.

Until now it has been generally assumed that the computational complexity of time-domain to frequency-domain transformation precluded the accomplishment of such transformation in realtime at any useful level of resolution on a microprocessor unassisted by a DSP. Indeed the DSP/Acquisition Board Selection Guide published by Hyperception, Inc. states flatly "If you intend to do ANYTHING to the data as it is going in or coming out in real-time, you must have a DSP. You will not be able to write optimized code to do some "simple processing" like vector transformations or adding offsets."

A search of the prior art represented in issued U.S. patents reveals a number of devices of interest to this application.

U.S. Pat. No. 4,641,343 to Holland et al. shows a microprocessor-based real time speech formant analyzer and display. This device detects voice formants F0, F1 and F2 and indicates the strength of formants F1 and F2 by moving an indicator through the x and y dimensions of a video display. Such a display enables a deaf user to identify vowels by the indicator's position on the screen, but it does not present a spectrograph. The strengths of only two frequencies, F1 and F2, are displayed and not the full range of frequencies used in speech communications. F1 and F2 are typically below about 1000 Hz. Many important features of vocal productions, and especially of fricatives, lie above this frequency in the range 1 kHz to 8 kHz.

Similarly, U.S. Pat. Nos. 4,276,445 and 4,401,805 to Harbeson demonstrate devices which display in realtime the strength of only the fundamental pitch, F0. U.S. Pat. No. 4,833,716 to Cote, Jr., shows a device which displays the relative power of only four frequency bands.

All prior methods of generating spectrographic displays suffer from one or more of the following disadvantages:

(a) They are not truly realtime devices, requiring that paper traces be loaded and unloaded, for example.

(b) They offer only intermittent representation of dynamic signals, as with spectrum analyzers.

(c) They do not offer continuous, uninterrupted realtime spectrographic display.

(d) They require the use of expensive data processing hardware such as mainframe computers or dedicated Digital Signal Processors.

(e) They provide realtime analysis of only one, or at most a small number, of frequencies.

(f) They offer relatively limited resolution of rapidly changing, dynamic signals.

(g) They display spectral power in a manner which makes accurate interpretation of spectral power difficult.

(h) They utilize a linear frequency axis which results in wasteful use of display area, which limits the total length of input signal which may be represented on a single display. In addition, the linear frequency axis makes visual interpretation of results relatively difficult.

As will be shown, the realtime embodiment of the present invention suffers none of these limitations.

OBJECTS AND ADVANTAGES

Several objects and advantages of the present invention are:

(a) to provide spectrographic analysis at lower cost than is currently available.

(b) to provide realtime spectrographic analysis at higher resolution than is currently available.

(c) to provide realtime spectrographic analysis in a portable, battery-operated device.

(d) to provide additional signal analysis such as amplitude and pitch reporting in realtime.

(e) to provide a spectrograph of improved legibility and clarity by utilizing display intensity and color simultaneously to display spectral power.

(f) to provide a spectrograph of improved legibility and clarity by utilizing a logarithmic scale on the frequency axis.

(g) to provide a display of a signal amplitude envelope of improved legibility and clarity by utilizing graphic displacement and display intensity simultaneously to encode signal amplitude envelope data.

(h) to provide a spectrograph offering high-quality, gray-scale printouts using an inexpensive, dot-array printer.

(i) to provide a realtime spectrograph which displays a telephone signal graphically.

(j) to provide a realtime spectrograph which displays the audio portion of a television signal.

(k) to provide a spectrograph which displays a reference standard spectrogram simultaneously with a spectrogram of a recently-input signal, to facilitate an analysis of the similarities and differences between the two spectrograms.

(l) to provide a spectrograph which displays a visual indicator of a user-specified reference pitch adjacent to a spectrogram of a recently-input signal, to facilitate the determination of the proximity in frequency of input signal features to the reference pitch.

(m) to provide a spectrograph which can store reference spectrograms in smaller data files than is possible under the prior art, thereby permitting the storage of more reference spectrograms on a data storage device of given capacity.

Still further objects and advantages will become apparent from a consideration of the ensuing description and drawings.

DRAWING FIGURES

REFERENCE NUMERALS IN DRAWINGS

Figure 1:
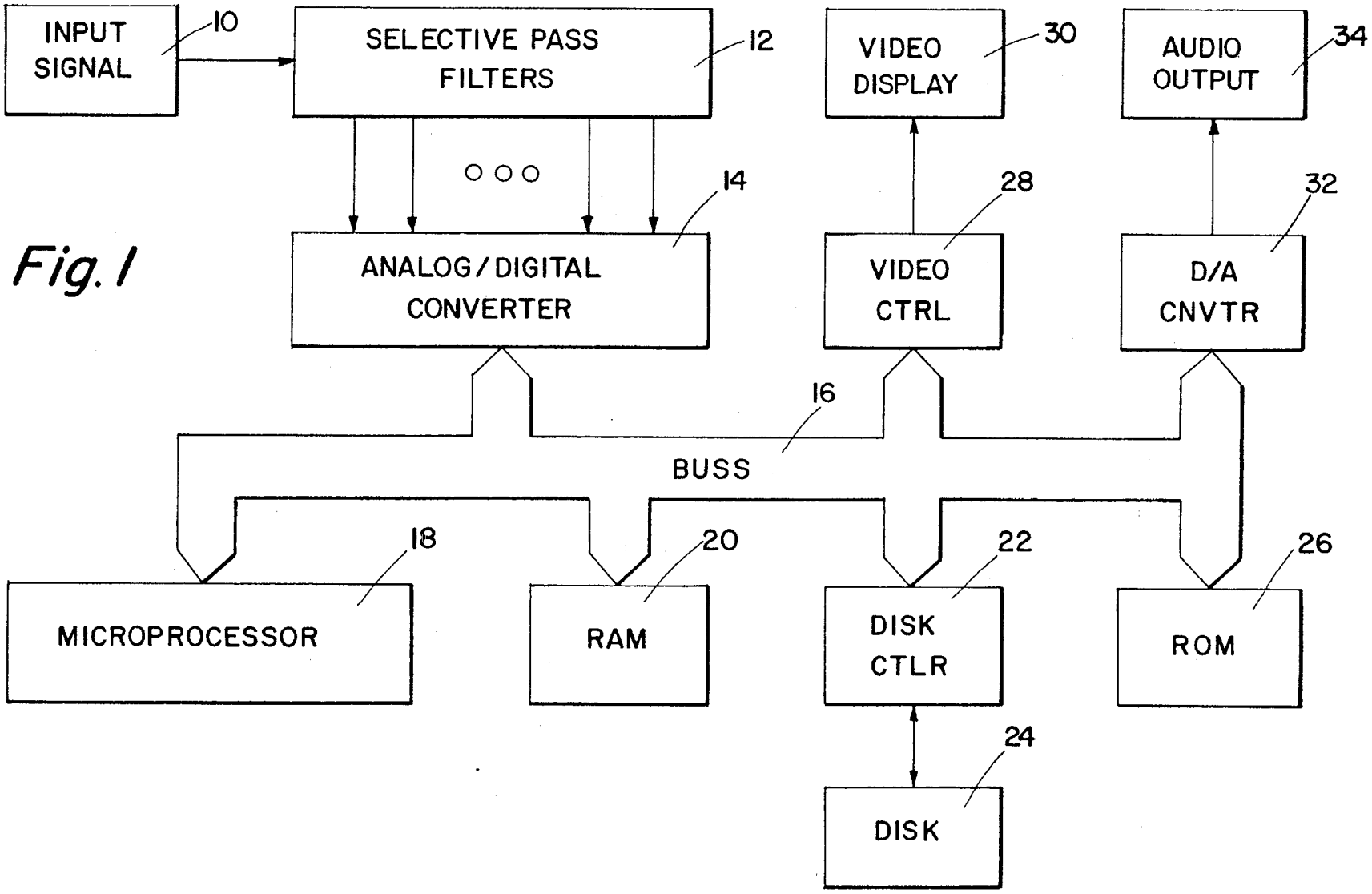
FIG. 1 is a block diagram of a realtime spectrograph realized according to the principles of the present invention.
Figure 2:
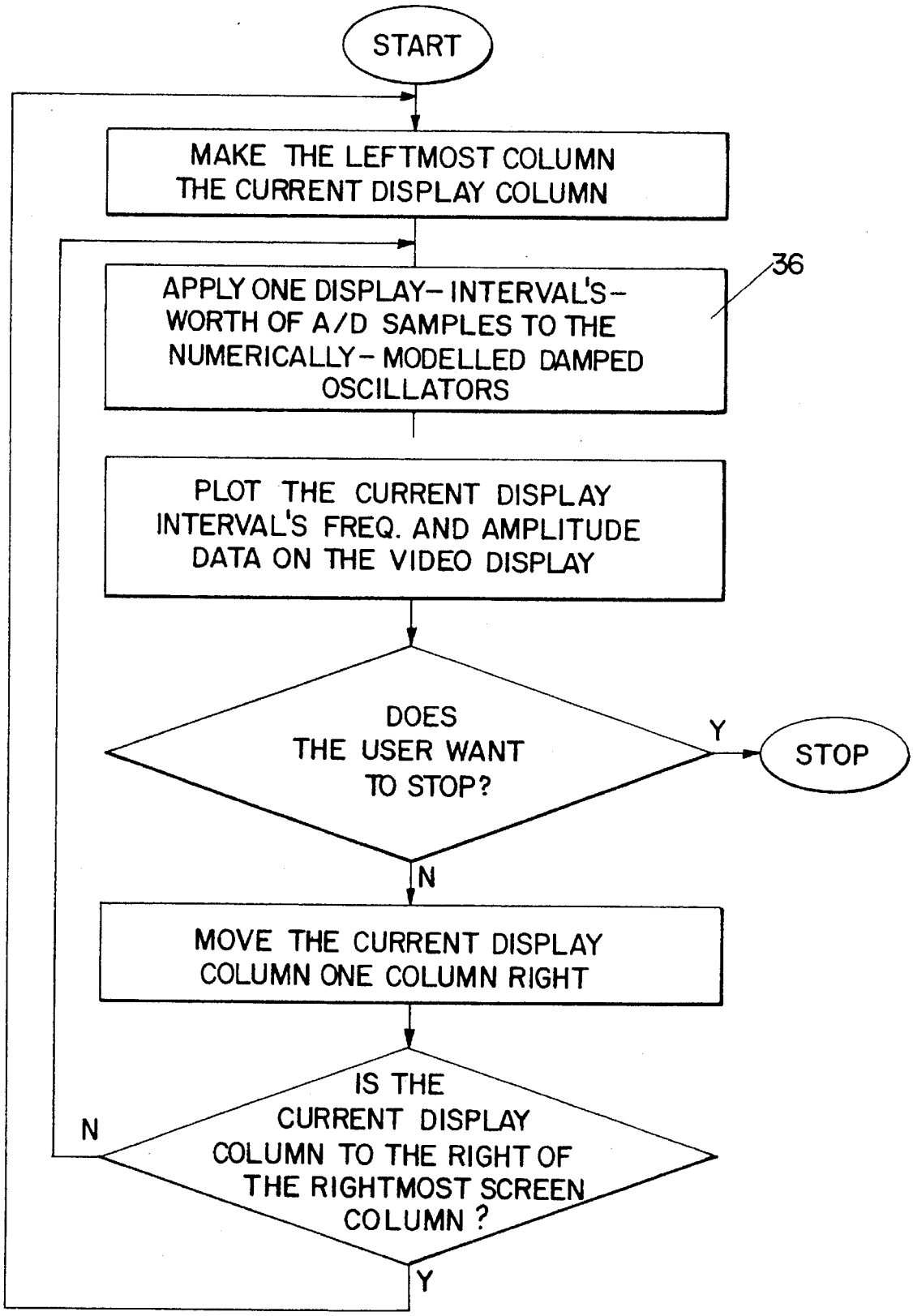
FIG. 2 is a flow chart of the main spectrogram-generation loop.
Figure 3:
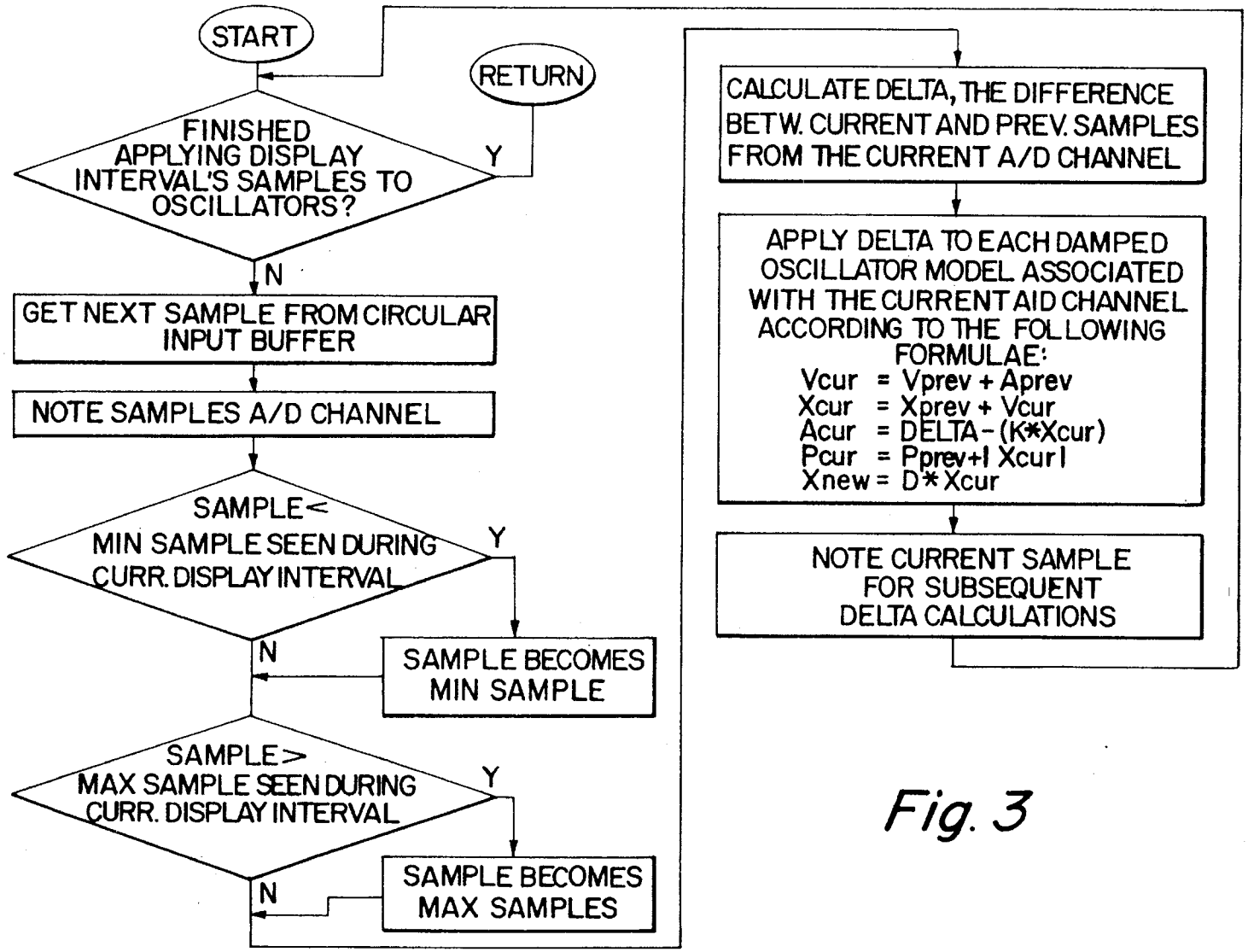
FIG. 3 is a flowchart of the sample-application subroutine.

10 Input Signal 12 Selective-Pass Filters
14 Analog/Digital Converter 16 Buss
18 Microprocessor 20 Random Access Memory
22 Disk Controller 24 Data Storage Disk
26 Read Only Memory 28 Video Controller
30 Video Display 36 Sample Application Sub.
38 Reference spectrogram 40 Input spectrogram
42 Amplitude display 44 Amplitude baseline
46 Reference pitch indicator 48 TV Input Signal
50 Video Tuner 52 Video Mixer/Overlay
54 Audio Tuner 56 Realtime Spectrograph
58 Video Display 60 Audio Output
62 Ring Line 64 Tip Line
66 Realtime Spectrograph 68 Spectrographic Display
70 Telephone Set

DETAILED DESCRIPTION

Input signal 10 is fed to the inputs of a plurality of selective pass filters 12. Each selective pass filter output is fed to one of the inputs of multiplexed analog-to-digital converter 14. One embodiment of the present invention utilizes seven low pass filters having cutoff frequencies at octave intervals relative to one another, the lowest cutoff frequency being 120 Hz and the highest being 7680 Hz. The analog-to-digital converter 14 is a multiplexed, single converter device which communicates with the microprocessor 18 and/or the Random Access Memory 20 via the buss 16. A multiplexer under program control selects one of a plurality of inputs to be fed to the analog-to digital (A/D) converter itself. In the preferred embodiment, a clock is used to trigger the taking of A/D samples asynchronously into a circular input buffer at a rate of 33500 samples per second. Other embodiments utilize different input data buffering arrangements such as Direct Memory Access (DMA). Under programmed control, the multiplexer selection is changed prior to each A/D sample such that every other sample is read from the output of the low pass filter with the highest cutoff frequency. Of the remaining samples, every other one of these is taken from the output of the low pass filter with the second-highest cutoff frequency. In turn, of the remaining samples, every other one of these is taken from the output of the low pass filter with the third highest cutoff frequency, and so on for all seven of the filter outputs. In this manner, the output of the filter having the highest cutoff frequency is sampled at twice the rate at which the output of the filter having the second-highest cutoff frequency is sampled, four times the rate of the filter having the third-highest cutoff frequency, and so on. In this manner, the frequency spectrum from 60 Hz to 7680 Hz is divided into seven bands, each of which is sampled at a rate approaching its respective Nyquist limit. The use of high-order filters having very steep rolloff permits the sampling of each band at a rate which is only slightly faster than twice the cutoff frequency. The sharp rolloff of the filters used prevents aliasing from occurring. By maintaining the sampling rate for each band near the Nyquist limit, detection of spectral components within each band is performed by processing a number of samples which is near the theoretical minimum required, thereby minimizing the processing power required of microprocessor 18.

Another embodiment of the present invention utilizes only one low pass filter, at the same cutoff frequency as the highest filter in the multi-band embodiment. An advantage of this embodiment is that only one filter is required, and thus the filter section 12 requires fewer components and is less expensive. A disadvantage of this embodiment is that the application of samples to the damped oscillator models described below requires approximately 3.5 times as many CPU cycles as is required by the application of samples under the multi-band embodiment, and hence the CPU required will tend to be more expensive than that required for the multi-band embodiment. Indeed, if one is using the fastest CPU available within a given family of CPUs, the reduction in computational requirements afforded by the multi-band embodiment makes possible the realization of realtime spectrographs of significantly higher resolution than would otherwise be possible.

The present invention uses a numerical model of an array of damped oscillators to detect a signal's spectral components. This model is maintained within microprocessor 18 and random access memory 20 and the model is periodically updated by using sample application subroutine 36 to apply successive input signal samples detected by the analog-to-digital converter 14, modifying model parameters accordingly. Each modeled oscillator has three quantities which determine its state at any given moment. The first quantity is displacement (X), the second is velocity (V), and the third is acceleration (A). In each successive modeling interval, the velocity Vcur is a function of the oscillator's previous velocity Vprev and previous acceleration Aprev. Similarly, in each successive modeling interval, the displacement Xcur is a function of the oscillator's previous displacement Xprev and current velocity Vcur. Finally, in each successive modeling interval, the acceleration Acur is a function of a) the product of the oscillator's previous displacement and a spring constant, plus b) the driving force applied to the oscillator. The spring constant K for each oscillator determines the resonant frequency of the oscillator and this constant is thus, in general, different for each oscillator. The difference DELTA between the latest sample taken and the previous corresponding sample taken represents the rate at which the input signal is varying and is thus the driving force applied to the oscillator. In addition, a damping factor is applied to the model in each modeling interval by multiplying the current displacement Xcur by a factor D somewhat less than one to arrive at a new current displacement Xnew. Factor D damps out oscillations in the absence of a driving signal. The spectral power Pcur of the input signal at the oscillator's resonant frequency is approximated by summing the magnitudes of the displacements Xcur observed.

While the preferred embodiment stores the computer program used by microprocessor 18 on the disk 24, other embodiments store the program in other storage devices such as Read Only Memory 26.

Each of the seven frequency bands described above has associated with it a plurality of damped oscillator models, each oscillator tuned to a different frequency. The average magnitude of displacement of a given oscillator model over a given time period is used as the measure of the input signal's spectral component strength at the oscillator's resonant frequency. This strength is displayed under program control by instructing the video controller 28 to plot a point of appropriate intensity and/or color on the video display 30. The spectrographic display plots frequency on the vertical axis and time on the horizontal axis. Thus each display interval is represented as a vertical column of picture elements (pixels), the pixels located higher on the display corresponding to the input signal spectral components which are higher in frequency. The intensity and/or color of each pixel are used to represent the spectral component strength of the associated frequency at each display interval in time. A display which encodes this strength using both pixel intensity and pixel color is observed to be a dramatic improvement in the representation of spectrographic data. Such data has traditionally been encoded utilizing either a varying intensity (which yields a gray scale image) or a varying color. It is observed that the encoding done by one embodiment of the present invention which represents low strengths as blue pixels of low intensity and high strengths as pink pixels of high intensity, with intermediate strengths coded along the color and intensity continuums between, greatly facilitates the user's perception of spectral strength and is a significant enhancement over the prior art.

Another aspect of the display generated by the present invention which is held to be an enhancement over the prior art in realtime spectrographs is the use of a logarithmic scale along the frequency axis. The prior art in realtime spectrographs utilizes a linear scale for the frequency axis. Earlier, non-realtime spectrographs offered a linear or logarithmic scaling of frequency. The fact that the output of the FFT method is scaled linearly and that conversion of this output to a logarithmic scale in realtime would be an additional computational burden has lead to logarithmic scaling being unavailable on modern realtime spectrographs. It is held that the logarithmic display is more useful for several reasons and that the present invention's efficient generation of display data which is logarithmically-scaled on the frequency axis is an enhancement over the prior art.

One advantage of the logarithmic scaling of frequency is that it is more useful for the display of voice signals. The human voice typically produces several frequencies simultaneously. These different pitches are called formants, and they are classified in order of ascending pitch. The lowest of these, the fundamental, is referred to as formant 0 (F0). The first formant above F0 is formant 1 (F1), and so on. Formants F1 and F2 are typically harmonics of F0, one and two octaves above the fundamental, respectively. Typical values of these formants might be 200 Hz, 400 Hz and 800 Hz. In a typical spectrograph utilizing linear scaling on the frequency axis and displaying the range of speech frequencies from 0 to 8000 Hz, these three formants would be displayed in just 7.5% of the vertical range of the display, making it difficult to differentiate them. A spectrograph utilizing logarithmic scaling (base 2) and displaying the range of speech frequencies in the seven octaves between 62.5 Hz to 8000 Hz would display these same formants in 28.6% of the vertical range of the display, providing adequate separation for easy differentiation. At the other end of the frequency range, the octave between 4000 Hz and 8000 Hz is used in human speech to encode fricatives such as the "s" sound. The only feature of interest in this range is the presence or absence of a broadband noise. Despite the lack of features requiring frequency differentiation in this region, linear spectrographs are forced to devote fully half of the display area to this one octave. The logarithmic spectrograph described above uses only 14.3% of the display area to represent this octave. By virtue of the display area savings realized by using a logarithmic display, the present invention is capable of displaying at full resolution 15 seconds worth of input data on one display screen, which is several times the capability of existing linear-frequency spectrographs.

It is interesting to note that the interpretation of what structure as may exist in a speech signal between 4000 Hz and 8000 Hz is actually made more difficult by the linear spectrograph's use of so much space to display the signal, since any features are greatly elongated vertically, making detection by the eye more difficult.

Another advantage of a logarithmic, base 2 representation of audio signals is that this distribution reflects human perception of sound. By way of illustration, note that musical notes which are separated by octave intervals are perceived to be "evenly" spaced. In addition, the distribution of notes used in Western music reflects a constant logarithmic relationship between the note pitches. The logarithmic scaling of pitch is held to be a more natural representation than a linear scaling, and one which makes interpreting the spectrographic display of speech easier. As such it is a significant advance over the prior art.

It is held that the current invention improves on the prior art in another aspect of the graphical display of a signal. By graphically displaying the logarithm of the signal amplitude envelope 42 as a vertical displacement from a horizontal baseline 44, distinctive features in the amplitude envelope, such as sudden increases associated with plosives in speech signals, may be displayed. Such features may be difficult to detect in the spectrographic display, but are very easy to note in a logarithmic amplitude display. Current realtime spectrographic devices which offer amplitude display offer only linear display of amplitude. Consequently, it is difficult, using these devices, to consistently detect amplitude changes over a large dynamic range. During periods of low signal strength, the vertical displacements are too small to be easily seen, while during periods of high signal strength, the displacement may exceed the display area assigned the amplitude display. The present invention greatly increases the dynamic range over which the amplitude display is effective by calculating and displaying the logarithm of the amplitude envelope. More precisely, the logarithm of the magnitude of the amplitude envelope is displayed, resulting in only positive displacements from the baseline and reducing by half the display area required for the envelope display. It is yet a further advantage of the present invention that the amplitude envelope baseline is displayed with an intensity which varies as the log of the signal amplitude envelope. Thus, when the input signal is strong, and the envelope display is significantly displaced from the baseline, the baseline itself is displayed brightly to highlight the amplitude and provide a solid baseline for visual reference. Conversely, when the input signal is weak and the envelope display is nearly linear and very close to the baseline, the baseline itself is displayed with much lower intensity, so as not to obscure the envelope display. It is held that coding the baseline intensity with the amplitude envelope signal greatly facilitates the interpretation of the amplitude envelope signal and is a significant improvement on the prior art.

Figure 4:
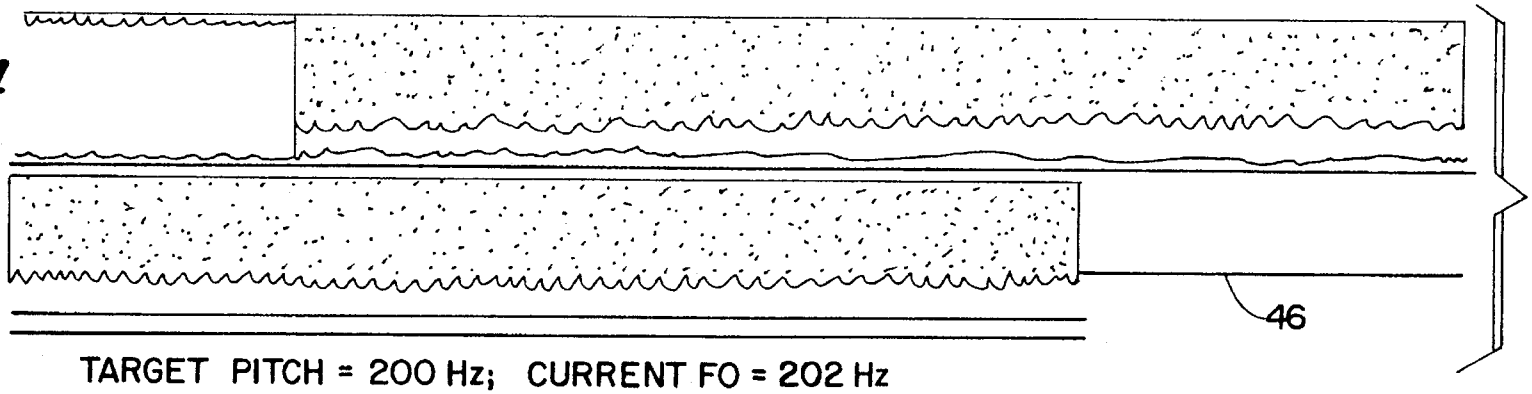
FIG. 4 is a representative output of the present invention showing a realtime spectrogram with adjacent reference pitch indicator.
Figure 5:
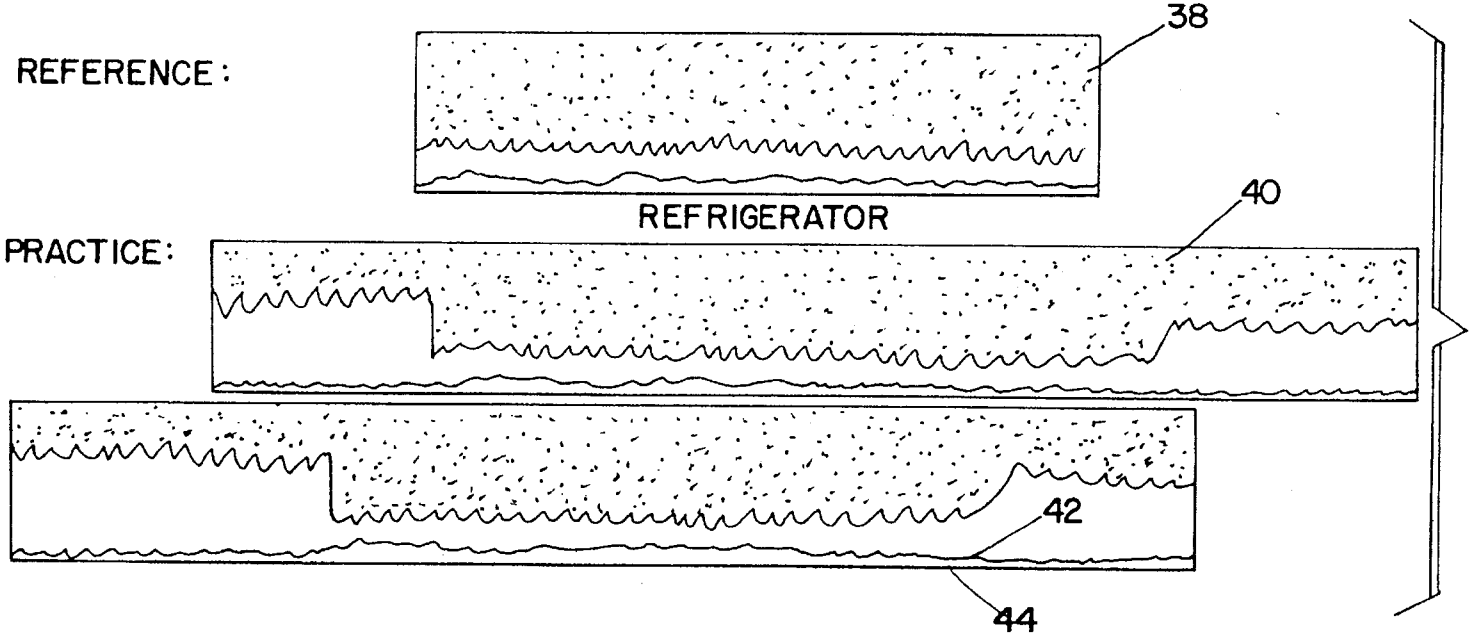
FIG. 5 is a representative output of the present invention showing a reference spectrogram above a realtime spectrogram.
Figure 6:
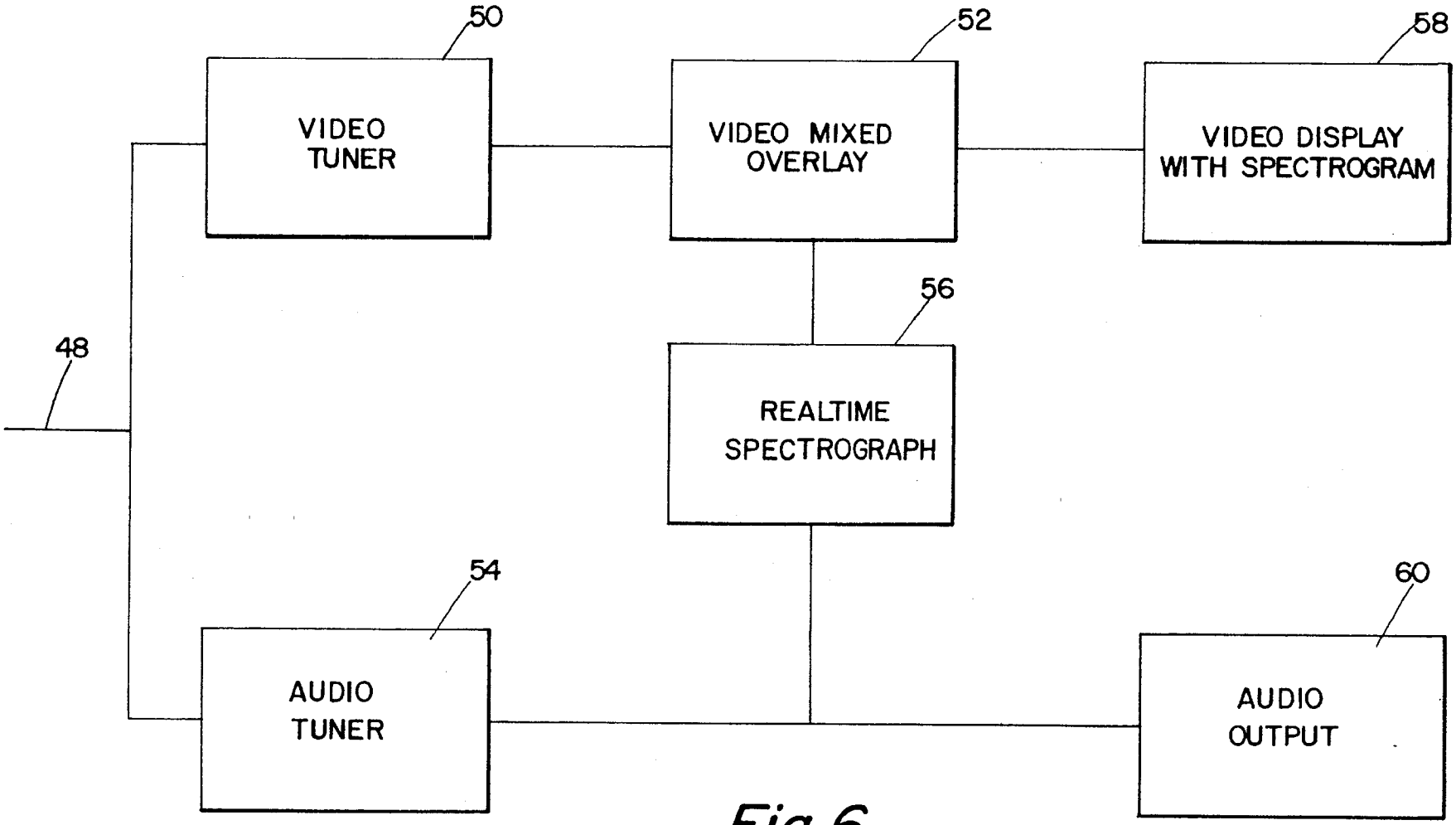
FIG. 6 is a block diagram of an embodiment of the present invention which represents the audio portion of a television signal graphically.
Figure 7:
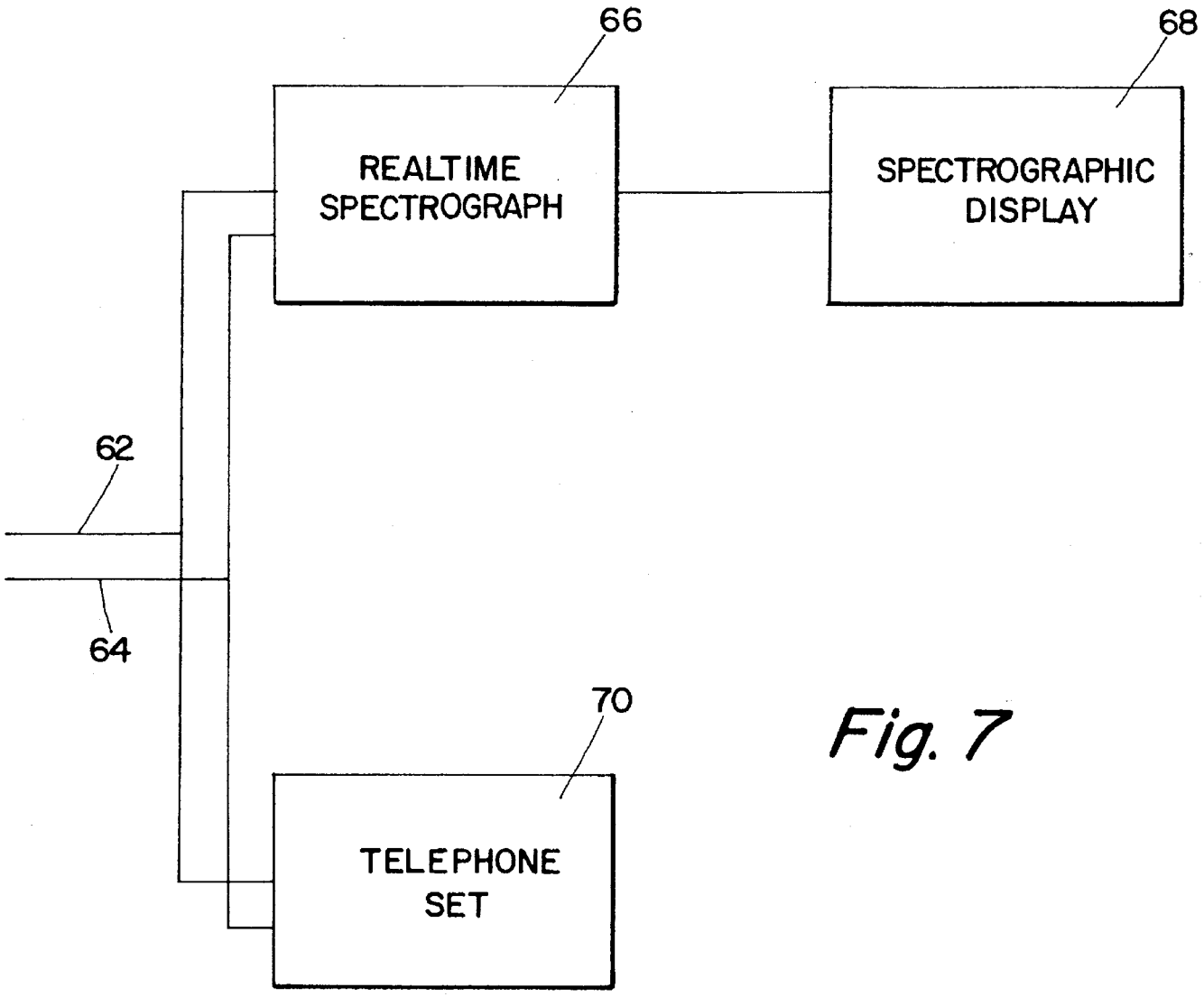
FIG. 7 is a block diagram of an embodiment of the present invention which represents a telephone signal graphically.

The provision of reference spectrograms adjacent to the spectrographic display of recent signal input for purposes of comparison of the two spectrograms is illustrated in FIG. 4. The present invention allows users to record spectrographic displays to disk 24 via disk controller 22 and to recall these displays on demand, with the added ability to display a spectrogram of current input 40 adjacent to the reference spectrogram 38. The ability thus provided to instantaneously compare current input signals against reference standards is of benefit whenever monitoring of an input signal for compliance with a reference signal is desired. This ability has been found to be of particular benefit in improving the articulation of speech therapy patients, for example. Another type of user-specified visual reference is illustrated in FIG. 5. By specifying a target pitch, the user causes a horizontal line 46 to be displayed adjacent to the realtime spectrogram at the vertical location of the pitch selected. As the spectrogram of the input signal is plotted, the target pitch line is overwritten. In this way, the target pitch is always illustrated immediately adjacent to the most-recently-written portion of the spectrogram, providing immediate visual feedback regarding the placement of the input pitch relative to the reference pitch. It is held that both forms of visual reference standards are novel and useful improvements to the art of realtime spectrographic displays.

Another accomplishment of the present invention is the realization of dramatic reduction in the size of data files containing stored reference signal inputs. This is accomplished by using one or more compression techniques. The preferred embodiment stores the spectrograhic output data and the amplitude output data rather than the raw input data read from the A/D converter. The process of generating the spectrographic output data and the amplitude output data is itself a very effective form of "lossy" compression, in which the least significant data is discarded in order to greatly reduce data size with a very minor reduction in total information content. One display interval in the preferred embodiment utilizes 192 bytes of input data from the A/D converter to produce spectrographic and amplitude output which require only 28.5 bytes to store, resulting in a net compression ratio of 6.7 to 1. Even if prior art spectrographs were to store their spectrogram data rather than A/D sample data, the net compression ratio would be much lower since a linear frequency axis requires a larger spectrogram display area as discussed above and thus requires also a larger data file to store the spectrogram data. Another embodiment of the present invention takes data compression a step further by compressing the spectrographic output data with additional compression algorithms such as LZW compression. While the actual magnitude of such additional compression depends upon the nature of the data being compressed, the presence of a great deal of regularity in most spectrograms results in substantial further compression being possible.

The present invention realizes a high-resolution printout of gray-scale images using a low-cost, dot-array printer. It is an accomplishment of the present invention that an entire screen image composed of pixels which directly represent sixteen levels of gray can be effectively represented on a single page using printer dots which are themselves either black or white.

In one embodiment, this is accomplished by associating an array of three adjacent potential locations of printer dots on the output page with each video display pixel. These round dot locations overlap slightly, producing a nearly 100% print density if all three dots are printed. There are three other densities available within a given set of three dots; roughly 66%, 33% and 0% for two, one or no dots printed, respectively. Thus four levels of gray can be directly represented by each set of three dots. It is an accomplishment of the present invention that the effective number of gray levels which may be represented by each set of three dots is increased from four to sixteen by use of statistical methods. This makes possible the representation of an entire display page composed of 16 levels of gray on a single page of paper in a standard printer such as the Epson FX-80. The increase is accomplished by assigning a set of probabilities of being printed to each dot for each of the sixteen levels of gray. Within each three dot set, dot number one is never printed if the display gray level is a value from 0 to 7, and always printed if the display gray level value is from 8 to 15. Thus, its set of probabilities is {0, 0, 0, 0, 0, 0, 0, 0, 1, 1, 1, 1, 1, 1, 1, 1}. Dot number two is never printed if the gray level is a value from 0 to 11, and always printed if the gray level value is from 12 to 15. Thus, its set of probabilities is {0, 0, 0, 0, 0, 0, 0, 0, 0, 0, 0, 0, 1, 1, 1, 1]. Finally, dot number three is printed in a probabilistic manner, with a probability somewhere between 0 and 1 for each gray level. In this manner, a three dot set is printed with one of two possible dot patterns. While each three-dot set is still limited to directly representing only 4 levels of gray, the cumulative effect of the probabilistic choice between the two possible dot patterns for a given display gray level is that sixteen levels of gray are effectively represented over larger areas of the printed output. The set of probabilities for dot number three are determined empirically by inspecting the average print density produced by particular probability values. It has been determined that the following set of values provides an effective representation of 16 levels of gray on an Epson FX-80 printer: {0.00, 0.05, 0.14, 0.24, 0.38, 0.52, 0.71, 0.90, 0.10, 0.29, 0.52, 0.81, 0.14, 0.45, 0.70, 1.00}. Other embodiments use different numbers of dots to represent each video display pixel, different target printers and different probability values.

One embodiment of the present invention is implemented on a battery-powered, portable computer. It is observed that portability is a significant enhancement over the prior art and that, given the relatively limited power of portable computers, the performance improvements realized by the present invention were necessary for the realization of a portable realtime spectrograph having significant bandwidth and resolution.

One embodiment of the present invention represents the audio portion of a television signal 48 in a graphical format on the television display. The output of audio tuner 54 is used as input by a realtime spectrograph 56 of the present invention. The output of the spectrograph is combined by video mixer/overlay 52 with the output of video tuner 50 to produce a combined video signal which is displayed on display 58. Other embodiments of the present invention provide the spectrogram on a separate display device.

One embodiment of the present invention represents a telephone signal in graphical format. The telephone signal which is carried as an alternating current signal between telephone lines Ring 62 and Tip 64 are processed by realtime spectrograph 66 and displayed on spectrographic display 68, enabling a deaf user to see the speech of all parties on the line, and enabling effective use by said deaf user of ordinary telephone set 70. An alternate embodiment of the present invention incorporates a spectrograph and display within a telephone set.

It is noted that the performance enhancements afforded by the present invention make possible the presentation of successive frames of spectrogram data at intervals of approximately 4.0 milliseconds when running on an Intel 486 CPU running at 50 MHz. This frame rate offers exceptional display resolution and is considered an advance over the prior art.

Other embodiments of the present invention utilize different types of filters, such as band pass filters, different cutoff frequencies, more or fewer frequency bands, or more or fewer damped oscillator models.

SUMMARY, RAMIFICATIONS, AND SCOPE

The reader will see that the present invention offers significant improvements over the prior art by providing high-resolution, realtime spectrographic analysis using far less powerful, and thus less expensive, data processing hardware. Further, the computational efficiency afforded by the present invention makes possible a very high frame rate, and thus results in significantly enhanced resolution over the prior art. Additionally, one embodiment of the present invention is implemented using a portable, battery-operated computer, offering the user increased flexibility and ease of use. The simultaneous use of both color and intensity to encode the spectrogram data for display makes interpretation of the data by the user faster and easier, as does the use of a logarithmic scale in the frequency axis. The simultaneous use of graphical displacement and intensity to encode the amplitude envelope data for display facilitates the user's interpretation of this data. The provision of visual reference standards adjacent to the realtime spectrogram aids the user's analysis of spectrographic feedback. Highly effective data compression is used to increase the total reference input signal length which may be stored. In addition, the use of statistical methods enables the generation of high resolution gray-scale images using inexpensive dot-array printers. Finally, use of the spectrograph with telephone and television audio signals enables access by the deaf to previously inaccessible sound information.

Although the description above contains many specificities, these should not be construed as limiting the scope of the invention but merely as providing illustrations of some of the presently preferred embodiments of this invention. The scope of the invention should be determined by the appended claims and their legal equivalents, rather than by the examples given.

I claim:

1. An economical method for developing frequency-domain information of audio signals in realtime and displaying said frequency-domain data as a spectogram which allows for the visual recognition of spoken words, said method comprising the steps of:

receiving a time-domain signal, said input signal having an input signal frequency;

filtering said received signal with an array of low pass filters, wherein each successive low pass filter has a cutoff frequency which is approximately twice the cutoff frequency of the low pass filter with the next lower cutoff frequency;

sampling the filtered output signal of each low pass filter, wherein each low pass filter is sampled at a higher rate than the rate of the low pass filter with the next lower cutoff frequency respectively;

mathematically modeling a receiver of said input signal, said mathematical model including a mathematical representation of a damped oscillator, said damped oscillator having a natural frequency;

processing said input signal through said mathematical model to detect the spectral power at said natural frequency of said damped oscillator;

capturing said spectral power in a medium to facilitate usage of said input signal;

representing said spectral power in a medium, said representation being a logarithmic function of said spectral power;

determining the amplitude of said received signal;

displaying an amplitude line offset from said base reference line a distance proportional to said amplitude;

displaying a prerecorded reference spectogram;

displaying a reference pitch indicator;

wherein said higher sampling rate is substantially twice the rate of the low pass filter with the next lower cutoff frequency; and wherein said power of said spectral components are displayed at an intensity and color which varies according to the respective power of each spectral component.

2. An apparatus for developing and displaying the frequency-domain representation of an audio signal for the purpose of visually communicating inputted spoken words, comprising:

an array of low pass filters;

an A/D converter in communication with said low pass filters, wherein said arrays have successive cutoff frequencies which are approximately twice the cutoff frequency of the low pass filter with the next lower cutoff frequency in succession;

a processor in communication with said A/D converter, wherein said processor is programmed to process information received from said A/D converter by applying said information to a numerical model of an array of damped oscillators to detect the power of the spectral components of said information;

a multiplexer in communication with said array of low pass filters and said A/D converter;

a storage device in communication with said A/D converter and in communication with said processor; and a display in communication with said processor, wherein said display graphically depicts the spectral components of said audio signal in a manner which will allow visual recognition of said signal.

3. The apparatus of claim 2, further comprising a storage device in communication with said A/D converter and in communication with said processor.

* * * * *